US005537790A

United States Patent [19]

Jackson

[11] Patent Number: 5,537,790

[45] Date of Patent: Jul. 23, 1996

[54] SEISMIC BRIDGE

[76] Inventor: Roger L. Jackson, 372 N. Bundy Dr., Los Angeles, Calif. 90049

[21] Appl. No.: 193,720

[22] Filed: Feb. 9, 1994

[51] Int. Cl.[6] ..... E01D 19/04

[52] U.S. Cl. ..... 52/393; 52/167.1; 52/167.4; 52/167.7; 52/167.8; 52/396.08; 52/402; 14/73.1; 14/73.5; 248/560; 248/565; 248/678

[58] Field of Search ..... 14/73.1, 73.5; 52/167.4, 167.1, 393, 396.08, 402, 167.7, 167.8; 248/560, 565, 678

[56] References Cited

U.S. PATENT DOCUMENTS

| | | | |
|---|---|---|---|
| 162,357 | 4/1875 | Eads . | |
| 3,269,638 | 1/1967 | Morlon . | |
| 4,250,671 | 2/1981 | Hirsch et al. . | |
| 4,371,143 | 2/1983 | Ishida et al. . | |
| 4,665,830 | 5/1987 | Anderson et al. . | |
| 4,946,128 | 8/1990 | Cunningham | 52/167.1 X |
| 4,953,658 | 9/1990 | Goto . | |

*Primary Examiner*—Carl D. Friedman
*Assistant Examiner*—Christopher Todd Kent
*Attorney, Agent, or Firm*—Pretty, Schroeder, Brueggemann & Clark

[57] ABSTRACT

A seismic bridge for bridging and providing pedestrian access across a seismic joint between two building parts has a first end unit with a floor pivotally connected to one of the building parts and a second end unit with a floor pivotally connected to the other building part. A corridor sleeve unit, also having a floor, is slidably connected to each of the first and second end units. During relative motion between the two building parts, such as during an earthquake, the bridge can accommodate relative motion between the building parts within a predefined range, while still maintaining the structural integrity of the bridge. The bridge also includes centering means for centering and properly positioning the corridor sleeve unit with respect to the first and second end units. The centering means uses springs in combination with a plurality of frames which are slidably connected to each other to maintain the appropriate distance between the end units and the corridor sleeve unit.

21 Claims, 8 Drawing Sheets

SEISMIC BRIDGE

BACKGROUND OF THE INVENTION

The present invention relates to seismic bridges and, more particularly, to a seismic corridor bridge for bridging and providing pedestrian access across a seismic joint in a base isolated building.

In the construction of buildings, special regulations and codes have been enacted over the years to ensure that buildings can withstand a certain amount of stresses due to thermal changes and, depending on the geographic location, to also withstand vibrations and forces generated during an earthquake. In geographical areas where earthquakes generally do not occur, seismic activity is not a concern and, therefore, routine expansion joints are used to control the effects of linear expansion and contraction from thermal changes. In geographical areas where earthquakes are known to occur, however, seismic joints are used to control the effects of thermal changes and to accommodate the unpredictable movements associated with a seismic event.

There are basically two types of building construction, generally known in the industry as fixed base construction and base isolated construction. In fixed base construction, the lower end of building columns are bolted or otherwise fixed to footings supported directly by the ground. Fixed base construction may be designed to resist up-lift as well as to carry building load. In contrast, in base isolated construction, the lower end of building columns are bolted to isolators which are, in turn, bolted to footings supported by the ground. Base isolated columns are designed to support building load, but they are not designed to resist up-lift.

The isolators used in base isolated construction typically comprise alternately laminated layers of rubber compound and steel plates which are steam cured into a single unit and capped on the top and bottom with thicker steel plates. The lower ends of the building columns are bolted to the top plates of the isolators, while the bottom plates are bolted to the tops of concrete footings supported directly by the ground. The isolators are designed to displace horizontally in any direction by absorbing the energy imparted to them by an earthquake, but over a time duration that is much longer than the earthquake cycle duration. While the isolators cannot change the amount of force imparted to the building columns by the earthquake, they can increase the time period over which the earthquake force acts on the building column, thereby dissipating the seismic impact.

To fully appreciate the problem solved by the present invention, it is necessary to understand the nature and magnitude of the building movements that occur in fixed base construction and base isolated construction. As described below, the seismic joints in both types of construction must be able to accommodate routine building displacement due to thermal changes, as well as the building displacement associated with the seismic event. But first, a brief example of a building having an expansion joint will be provided as preliminary background.

As noted above, expansion joints are used in fixed base construction when there is no concern about the possibility of an earthquake. By way of example, in a 6 story steel building that is 300 feet wide and 600 feet long, the 600 foot length of the building will induce unwanted structural stresses and actual ruptures in finish materials, both interior and exterior, through the linear expansion and contraction caused by thermal changes. To control the effects of these thermal changes, an expansion joint will be used to separate the building structurally into two separate 300 square foot blocks that are adequately separated from each other, for example, by about 6 inches. Thus, if each of the 300 square foot blocks should expand at the roof line by 3 inches, to make the plan dimension of each block 300 feet 3 inches square, then an acceptable clearance of 3 inches would still remain in the expansion joint at the roof line of the building.

When a building having fixed base construction is located in an area known to have earthquakes, seismic joints are used instead of expansion joints. These seismic joints must be able to accommodate the same dimensional change due to thermal expansion of the type described above. In addition, the seismic joints must be able to accommodate seismic drift, also known as seismic sway. Seismic drift is the horizontal displacement or distortion of a building frame that occurs in resisting earthquake energy imparted to the building during a seismic event. In fixed base construction, the building displacement from seismic drift occurs at all floor levels and the roof above the first or ground floor. However, there is generally no displacement at the first floor, because the building columns are bolted to the footings supported directly by the ground. In a six story building, the seismic drift at the roof line may be as high as 9 inches relative to the ground floor. Therefore, in computing the clearance dimension that is necessary in a seismic joint under extreme seismic and thermal conditions, the width of the seismic joint under neutral conditions should include a 3 inch clearance under extreme thermal and seismic conditions, about 3 inches for thermal expansion, and about 18 inches for seismic drift (i.e., 9 inches for each part of the structure adjacent to the seismic joint, assuming the adjacent structures are moved toward each other). Thus, the total clearance dimension of the seismic joint in the neutral position is approximately 24 inches.

While the foregoing 24 inch calculation accounts for movement of adjacent structures perpendicular to the seismic joint, similar displacements parallel to the seismic joint are just as likely to occur. Moreover, if a seismic event causes the two parts of the structure adjacent to the seismic joint to move away from each other, without any thermal expansion, the 24 inch neutral seismic joint dimension would increase to approximately 42 inches (comprised of the 24 inch clearance dimension of the seismic joint in the neutral position as calculated above, plus an additional 18 inches of seismic drift of the structures away from each other).

Even further types of displacements must be accommodated in seismic joints in base isolated construction. The seismic joints in base isolated construction must be able to accommodate the displacements caused by thermal expansion and seismic drift described above, as well as displacement allowed by the isolators. The isolators allow building displacement to occur at all floor levels and the roof, including the first floor, which is elevated above the footing by the isolator but may be at the same elevation as the grade outside the building. However, in the six story building being used as our example, seismic drift may decrease from about 9 inches to about 3 inches since some of the earthquake energy is dissipated directly in distorting the isolators. In this regard, the isolators will be designed to support columns that face each other across the seismic joint, with the isolators for these columns being bolted to a common concrete footing. Assuming that the isolator will allow displacements horizontally in any direction from neutral in the range of about 24 inches, then the width of the seismic joint in the neutral position would be calculated by providing a 3 inch clearance under extreme thermal and seismic conditions, 3 inches for thermal expansion (as calculated above), an additional 6 inches to allow for seismic drift (assuming the adjacent structures move toward each other), and approximately 48 inches for isolator displacement under extreme seismic activity (24 inches for each part of the structure adjacent to the seismic joint, assuming the adjacent structures are moved toward each other). Thus, the total clearance dimension of the base isolated seismic joint in the neutral position is approximately 60 inches.

However, if the seismic event causes the two parts of the structure adjacent to the seismic joint to move away from each other, without any thermal expansion, then the 60 inch neutral seismic joint dimension would increase by another 54 inches under extreme seismic activity, now bringing the total seismic joint dimension to approximately 114 inches (comprised of 60 inches for the clearance dimension of the base isolated seismic joint in the neutral position, as calculated above, plus an additional 48 inches for displacement of the isolators away from each other, plus another 6 inches for seismic drift of the structures away from each other).

In the foregoing situations, where the seismic joint may expand to as much as 114 inches between adjacent building structures, very unusual and difficult problems are presented. For example, special care and consideration must be given in order to provide a bridge or walkway that provides constant internal cross-sectional dimensions and allows pedestrian access between the adjacent building structures on opposite sides of the seismic joint. Most certainly, the bridge should be designed to accommodate the range of relative movements, as described above, between the two building structures across the seismic joint. The bridge also should be designed to accommodate a range of such relative movements that is as wide as possible, without sacrificing the structural integrity of the bridge. Thus far, no satisfactory bridges have been developed to meet these design parameters.

Accordingly, there has existed a definite need for a seismic bridge that provides pedestrian access across a seismic joint separating two building structures, especially structures having base isolated construction, and that accommodates a relatively wide range of movements between the two building structures, such as during an earthquake, without compromising the structural integrity of the bridge. The seismic bridge of the present invention satisfies these and other needs and provides further related advantages.

SUMMARY OF THE INVENTION

The present invention provides a seismic bridge for providing pedestrian access across a seismic joint separating two parts of a seismically isolated building structure. The bridge comprises a first end unit having one end pivotally connected to one building part, and a second end unit pivotally connected to another building part on the opposite side of the seismic joint. Each of the end units has a free end extending away from its respective building part toward the space provided by the seismic joint. These free ends are slidably connected to a corridor sleeve unit that completes the bridge and provides pedestrian access across the seismic joint between the two building parts.

The seismic bridge of the present invention has particular utility in providing pedestrian access across a seismic joint separating two seismically isolated building parts that are constructed using base isolated construction. To this end, the first and second end units each have a semi-cylindrical end portion that is received within a corresponding semi-cylindrical socket in each of the building parts. These semi-cylindrical end portions also are connected to the building parts by a pivot apparatus that permits rotational and pivoting motion of the end units. Hence, the end units can rotate about a vertical axis and tilt from the horizontal along an axis that is substantially parallel to the seismic joint. This structure, in combination with the corridor sleeve unit that is slidably connected to the end units, allows the bridge to accommodate a relatively wide range of relative movement between the two buildings parts.

Thus, for example, when the two building parts move horizontally side-to-side with respect to each other, such as during an earthquake, the end units can pivot with respect to the building parts to accommodate this motion. Similarly, if the buildings move vertically up and down with respect to each other, the end units can tilt from the horizontal to accommodate this motion. In addition, because the corridor sleeve unit is slidably connected to the end units, movement of the two buildings horizontally toward or away from each other also can be accommodated by the bridge. Not only can the seismic bridge accommodate all of these motions, it can accommodate any combination of these motions, at the same time, without compromising the structural integrity of the bridge. Moreover, in view of its unique but relatively simple structure, the bridge can accommodate relatively wide ranges of movements between the two building parts, such as seismic drift and building displacements caused by motion of isolators that support the columns of the building parts.

In one aspect of the invention, the bridge includes centering means for centering and properly positioning the corridor sleeve unit with respect to the first and second end units. The centering means according to one embodiment comprises a first frame connected to the first end unit, and a second frame connected to the second end unit. A center frame connected to the corridor sleeve unit has a first end slidably connected to the first frame and a second end slidably connected to the second frame. By using one or more springs biased between the first frame and the center frame, and one or more springs biased between the second frame and the center frame, proper positioning and centering of the corridor sleeve unit relative to the first and second end units are achieved.

In another aspect of the bridge, the first and second end units each have a substantially horizontal floor plate and a substantially horizontal ceiling joined together by substantially vertical side walls. The corridor sleeve unit also may have a similar structure, with a floor, ceiling and adjoining side walls. In this embodiment, the corridor sleeve unit is received within the first and second end units and is properly positioned with respect to those end units by the centering means described above. It will be appreciated however, that the bridge need not be a completely enclosed structure and may contain only a floor, depending upon the needs at hand.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DESCRIPTION OF THE PREFERRED EMBODIMENT

As shown in the exemplary drawings, the present invention is embodied in a seismic bridge, generally referred to by the reference number 10, for bridging a seismic joint 11 and providing pedestrian access between two building parts 12 and 14 on opposite sides of the seismic joint. The seismic bridge 10 has particular utility in bridging and providing pedestrian access across a seismic joint between two building parts that are seismically isolated from each other, such as base isolated building construction. As explained below, the unique structure of the seismic bridge 10 accommodates relatively wide ranges of motions between the two building parts 12 and 14, without compromising the structural integrity of the bridge. Moreover, the seismic bridge 10 is designed to be reliable in use, relatively simple to manufacture and erect, and without requiring any significant maintenance.

Figure 1:
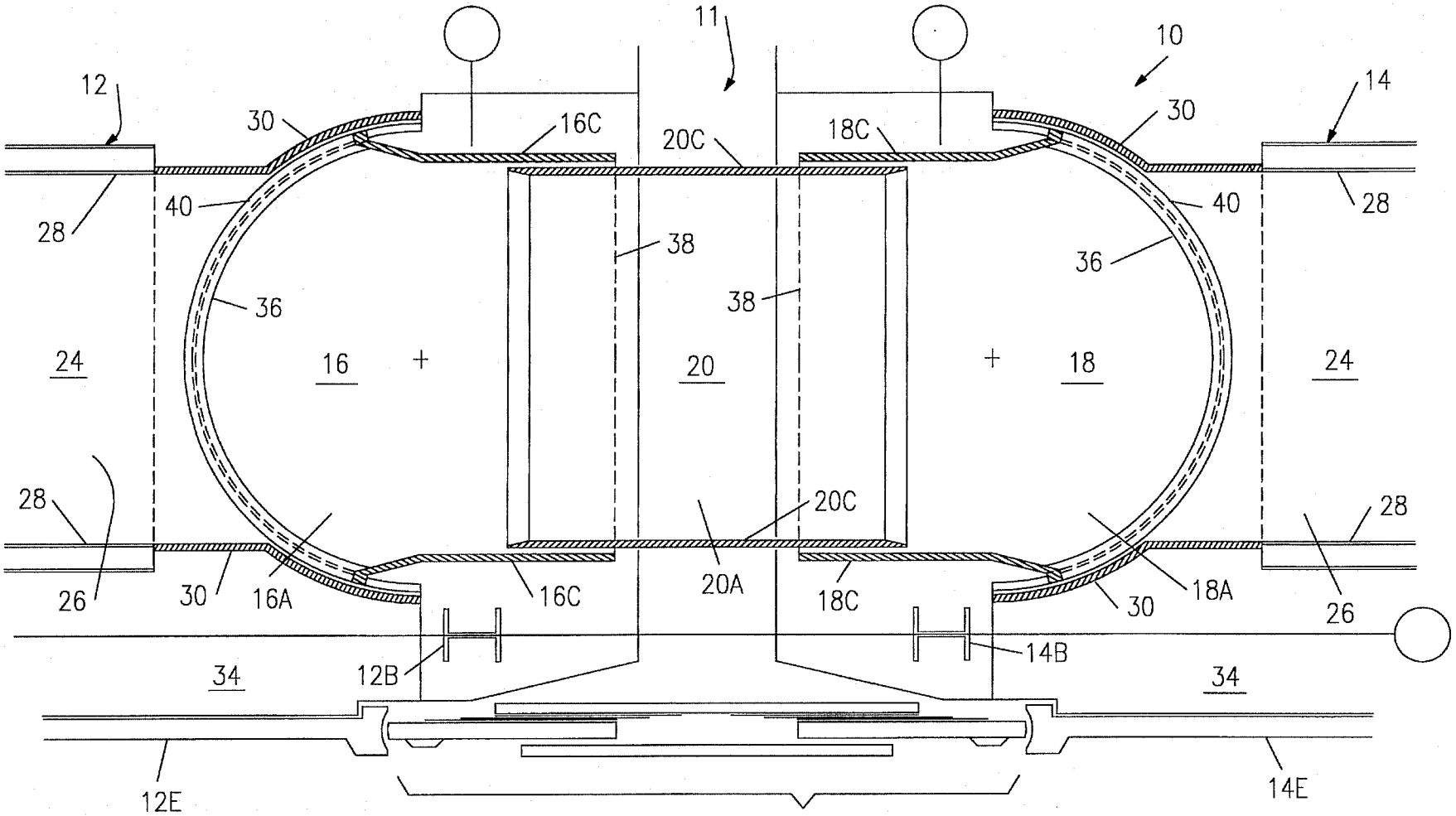
FIG. 1 is a cross-sectional plan view of a seismic bridge, embodying the novel features of the present invention, for bridging and providing pedestrian access across a seismic joint in a base isolated structure.
Figure 2:
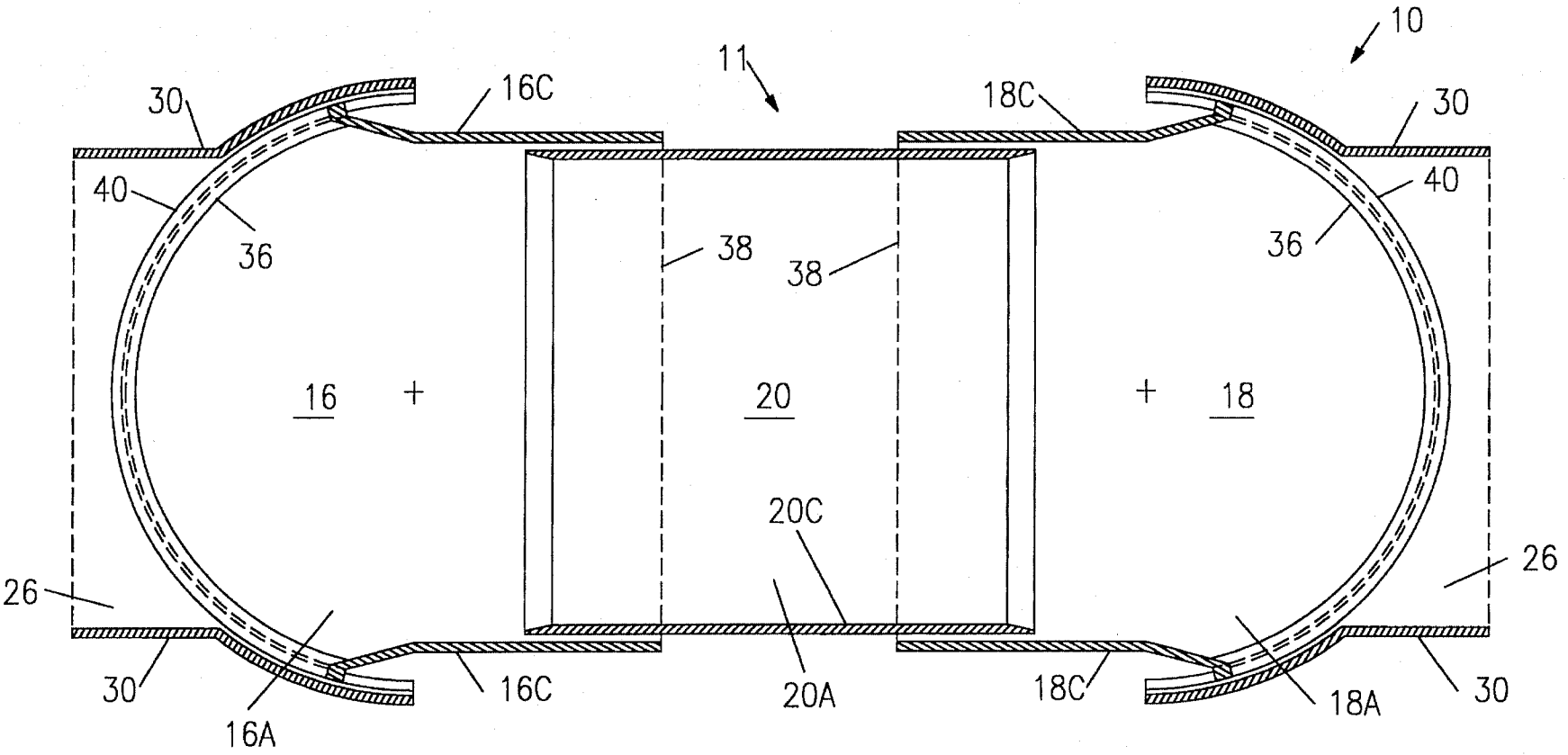
FIG. 2 is another cross-sectional plan view of the bridge, with the structure of the building removed.
Figure 3:
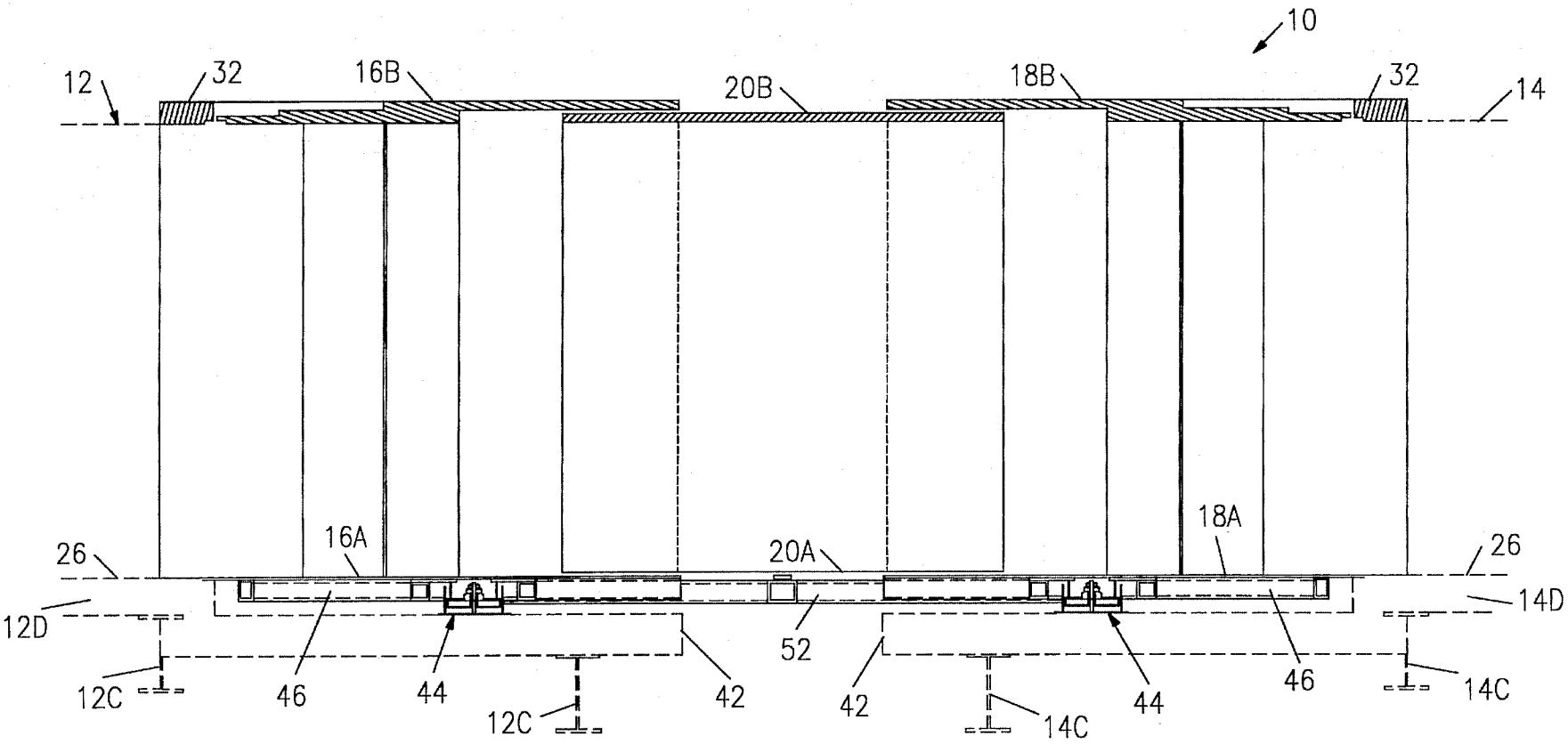
FIG. 3 is a longitudinal cross-sectional elevational view of the bridge.

FIGS. 1–2 illustrate plan views of the seismic bridge 10. The bridge 10 comprises three main structural components, comprising a first end unit 16, a second end unit 18 and a corridor sleeve unit 20 that is slidably connected to each of the end units. It will be noted that the end units 16 and 18 are essentially identical in configuration. Each of these end units 16 and 18 and the corridor sleeve unit 20 has a floor plate 16A, 18A and 20A, respectively, to accommodate pedestrian travel across the bridge 10. In addition, as shown in FIG. 3, each of these units also may respectively have a ceiling panel 16B, 18B, 20B and sidewalls 16C, 18C and 20C connecting the ceiling panels to the floor plates. In this way, a completely enclosed bridge may be provided to protect pedestrians, equipment or other things as they traverse the seismic bridge 10 bridging the seismic joint 11.

As shown best in FIGS. 1–3, the two building parts 12 and 14, separated by a seismic joint 11, are independently supported on base isolators at foundation level so that the two building parts are also seismically isolated from each other. Thus, each building part 12 and 14 will have its own separate set of building columns 12B and 14B (FIG. 1) and a separate set of building beams 12C and 14C which support floors 12D and 14D of the building to which the bridge 10 is pivotally connected. If desired, exterior building walls 12E and 14E of each building part 12 and 14 may extend toward each other and be joined to each other by seismic joint cover panels 22. However, it will be appreciated that the seismic bridge 10 of the present invention has utility with structures other than buildings, and the bridge may be readily adapted for other purposes as is necessary to provide pedestrian access across two structures.

Each building part 12 and 14 preferably has a corridor 24 or other type of pedestrian path, comprising a building floor 26 and corridor side walls 28, to which the bridge 10 is connected. The corridor side walls 28 of each building part 12 and 14 may be extended outwardly toward the seismic bridge 10 by providing wing walls 30 which are anchored to the building floor 26 at the bottom and to a wing wall ceiling panel 32 at the top. The exterior building walls 12E and 14E and their related seismic joint cover panels 22 provide an interstitial space 34 between the exterior building walls 12E and 14E and the outermost building corridor side wall 28.

The end units 16 and 18 and the corridor sleeve unit 20 may have their sidewalls 16C, 18C and 20C and ceiling panels 16B, 18B and 20B constructed from lightweight materials, such as metal-faced honeycomb core panels. The wing walls 30 and wing wall ceiling panels 32 may be constructed from similar materials. This helps reduce the weight of the seismic bridge 10 and provides sound substrates for interior finishes.

Figure 4:
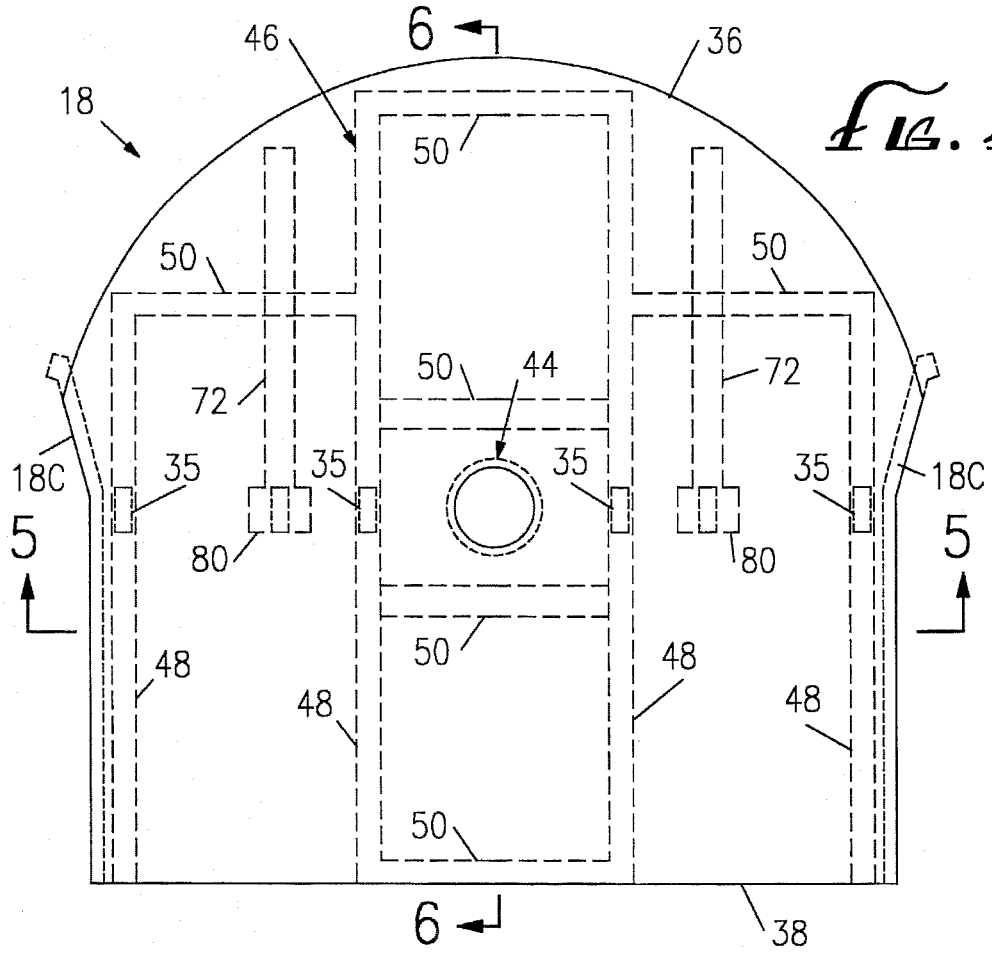
FIG. 4 is a plan view of an end unit of the bridge, showing the floor plate outline and the frame of the end unit in phantom lines below the floor plate.
Figure 5:
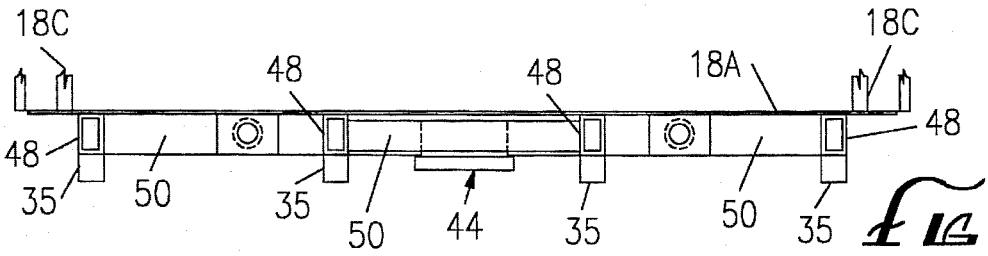
FIG. 5 is a cross-sectional elevational view of the end unit, taken substantially along line 5—5 of FIG. 4.
Figure 6:
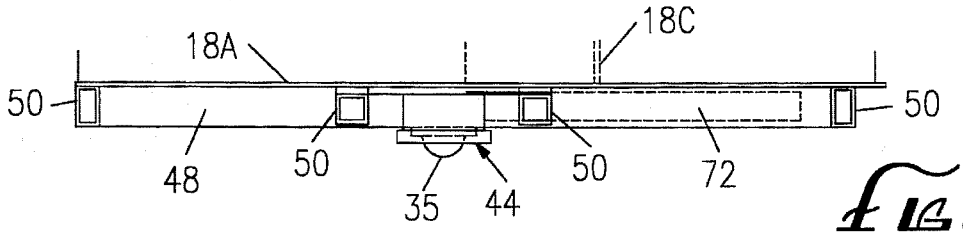
FIG. 6 is a longitudinal cross-sectional elevational view of the end unit, taken substantially along line 6—6 of FIG. 4.
Figure 12:
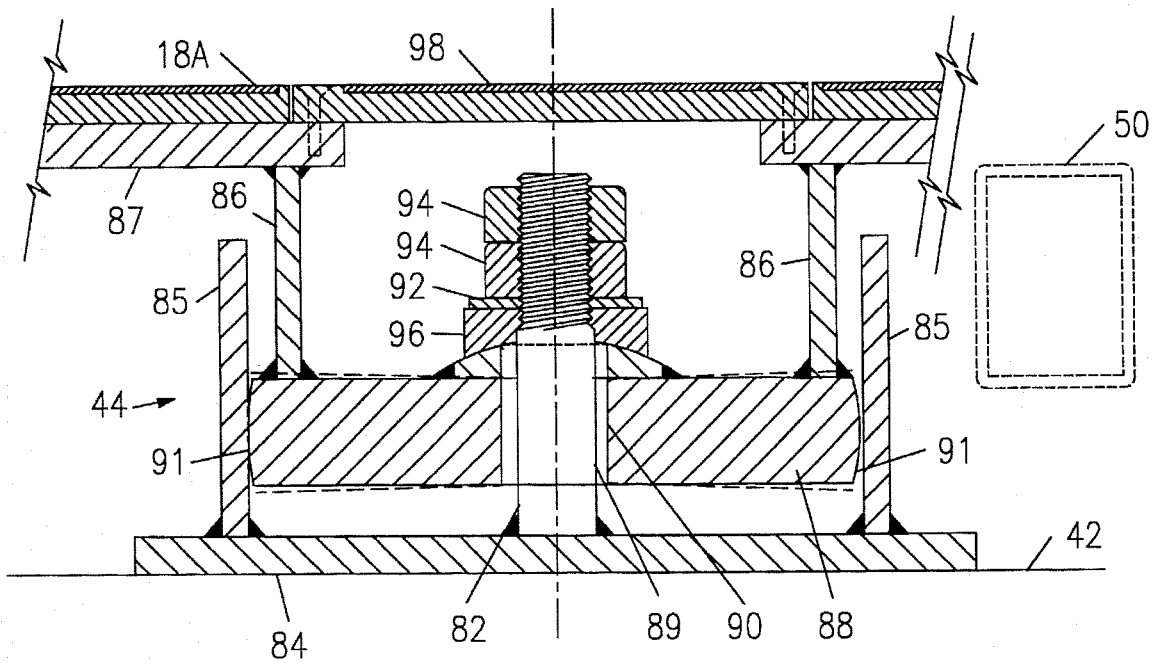
FIG. 12 is a cross-sectional elevational view of a pivot apparatus for connecting the seismic bridge to the building and permitting the end units to pivot and tilt with respect to the building parts to which they are attached.

FIGS. 4–6 show a plan view and two sectional views of one of the identical end units, for example, the second end unit 18. The end unit 18 has four feet 35 which contact and support the end unit 18 above a recess in a sub-floor 42, described below. The end unit 18 has a semi-cylindrical end 36 and a flat or free end 38. The semi-cylindrical end 36 of the end unit 18 is received within a corresponding semi-cylindrical socket 40 of the building part 14. The underside of the end unit 18 also is connected to a sub-floor 42 of the building part 14 by a pivot apparatus 44. This pivot apparatus 44 is best illustrated in FIG. 12 and is described in more detail below. The free end 38 of the end unit 18 is slidably connected to the corridor sleeve unit 20 such that the sleeve unit and the end unit can slide relative to each other. FIGS. 4–6 also show an end frame 46 that is connected to the underside of the floor plate 18A of the end unit 18. The end frame 46 comprises four tubular longitudinal beams 48 connected together by several tubular transverse beams 50. The end unit 18 is connected to the end frame 46 by appropriate mechanical fastening devices.

Figure 7:
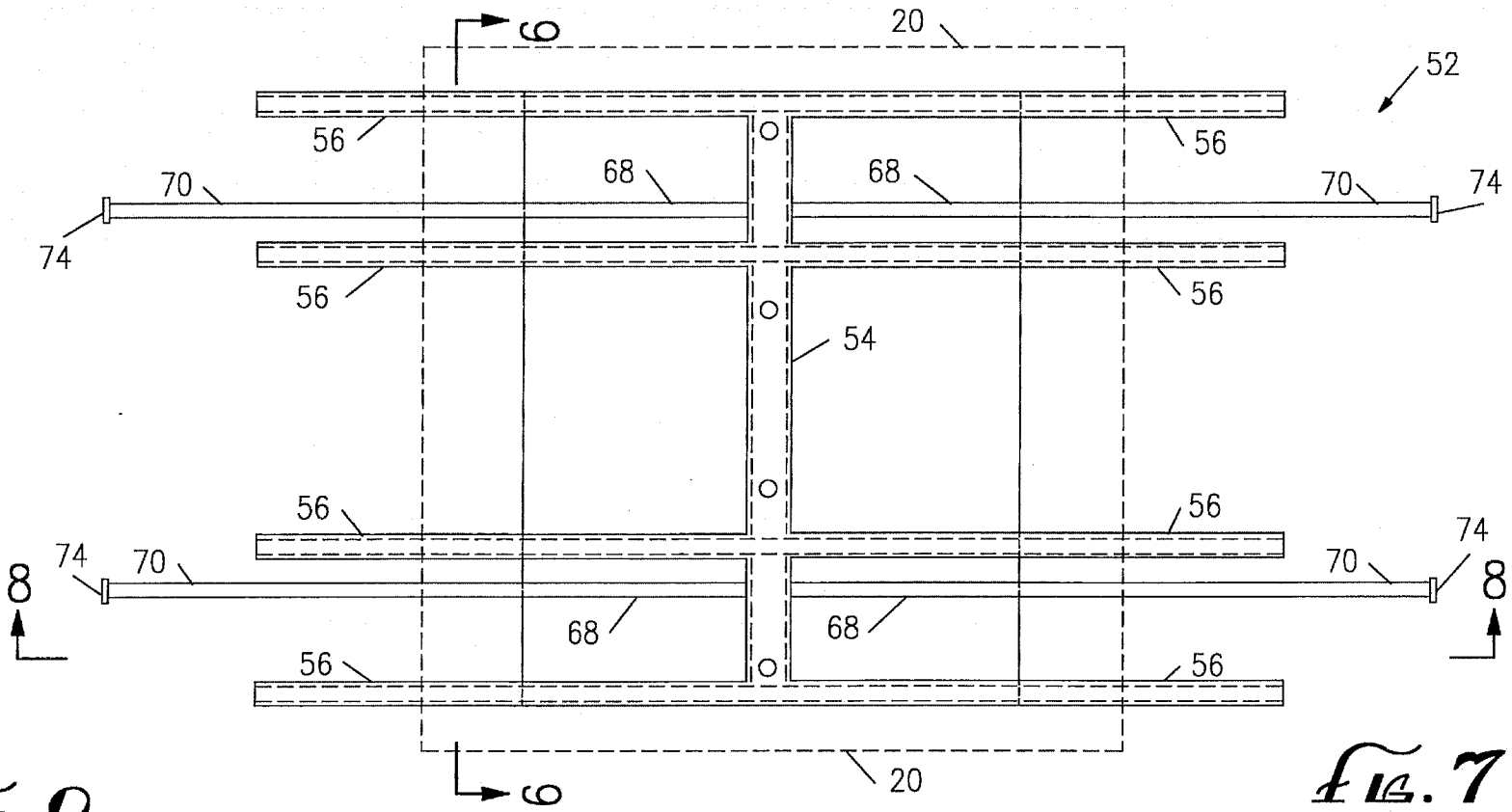
FIG. 7 is a plan view of the center frame of the bridge, with the corridor sleeve floor plate shown in phantom lines.
Figure 8:
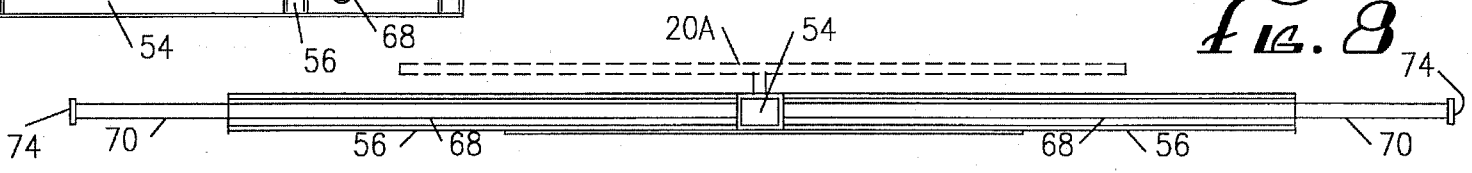
FIG. 8 is a longitudinal cross-sectional elevational view of the center frame, taken substantially along line 8—8 of FIG. 7, with the corridor sleeve floor plate shown in phantom lines above the center frame.
Figure 9:
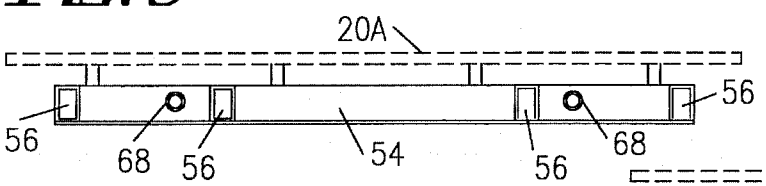
FIG. 9 is a cross-sectional elevational view of the center frame, taken substantially along line 9—9 of FIG. 7, with the corridor sleeve floor plate shown in phantom lines above the center frame.

FIGS. 7–9 show a center frame 52 which is connected to the underside of the corridor sleeve unit 20. The center frame 52 comprises a tubular traverse or center beam 54 and four tubular longitudinal beams 56 extending from opposite sides of the center beam. Each of the longitudinal beams 56 of the center frame 52 are configured and arranged to be slidably connected to the longitudinal beams 48 of the end frame 46 of each end unit 16 and 18.

Figure 10:
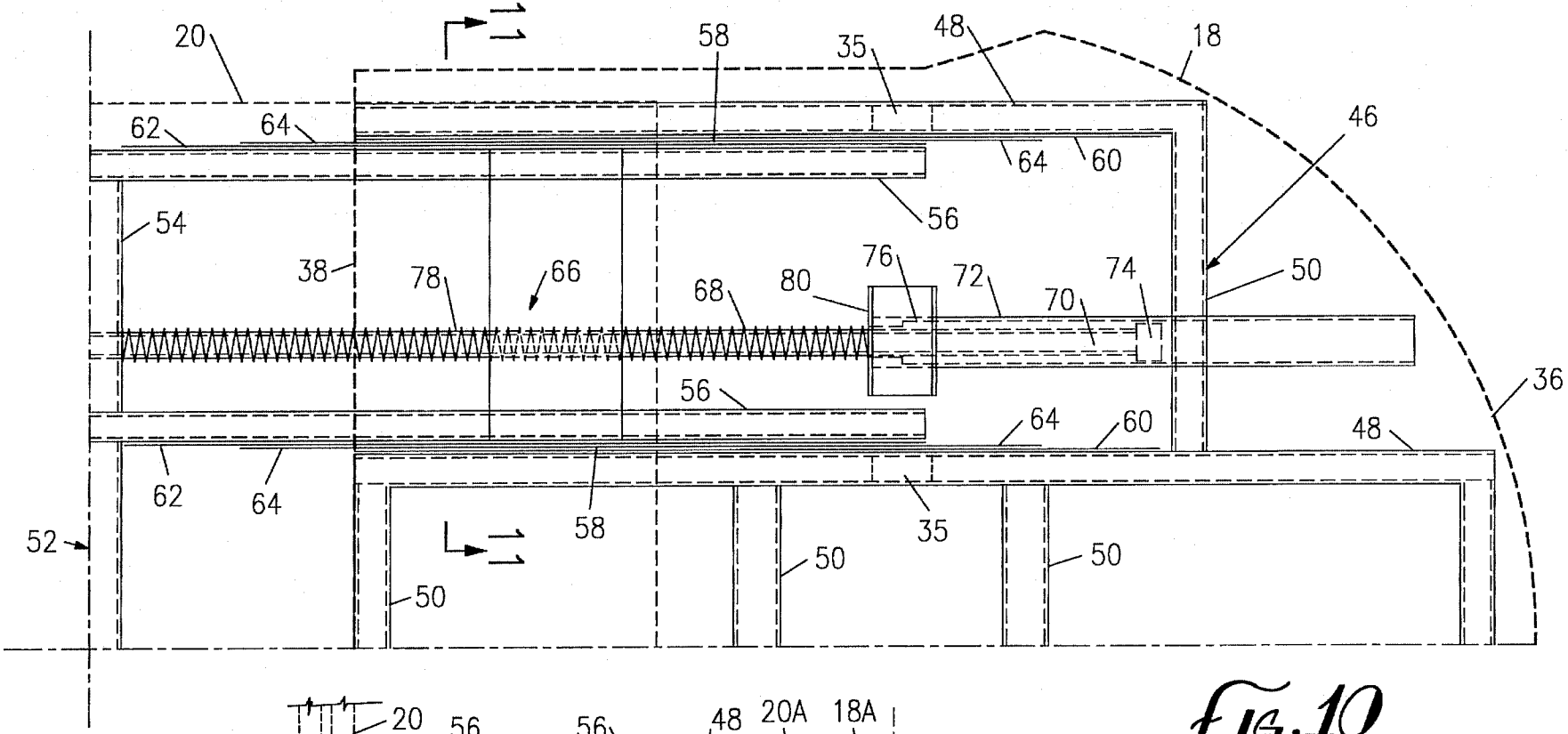
FIG. 10 is a plan view of a section of the end unit, showing the cooperation between the center frame and the end unit frame.
Figure 11:
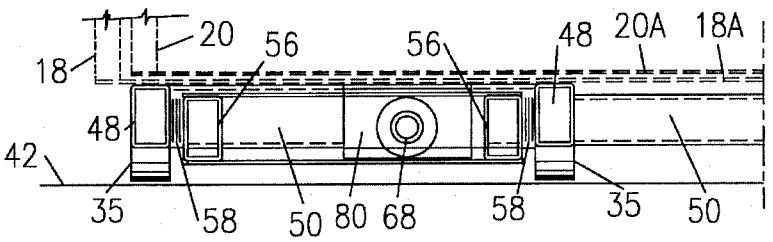
FIG. 11 is a cross-sectional elevational view of the bridge, taken substantially along line 11—11 of FIG. 10, showing the cooperation between the center frame and the end unit frame.

Thus, as shown in FIGS. 10–11, two longitudinal beams 56 of the center frame 52 are shown arranged alongside two longitudinal beams 48 of the end frame 46 of one end unit 18. For purposes of simplicity and clarity, only a half-section of the end unit 18 is shown in FIGS. 10 and 11, together with a quarter-section of the corridor sleeve unit 20. However, it will be appreciated that the other portions of the end frame 46 and center frame 52 are slidably connected to each other in a similar manner, since the seismic bridge 10 is symmetrical in plan about quadranting centerlines.

In one embodiment, the longitudinal beams 56 of the center frame 52 and the longitudinal beams 48 of the end frame 46 are slidably connected to each other by telescoping hardware 58. This telescoping hardware 58 is similar in structure, but on a larger scale, to the telescoping hardware that is used to connect full extension desk draws to a desk in an office or the like. Thus, each piece of telescoping hardware 58 will have a first panel 60 connected to a longitudinal beam 48 of the end frame 46, a second panel 62 connected to a longitudinal beam 56 of the center frame 52, and a third panel 64 positioned in between the first and the second panels, to provide increased telescoping extension of the end frame 46 with respect to the center frame 52. Appropriate bearings and other conventional sliding mechanisms (not shown) permit the relative sliding between the first, second and third panels 60, 62 and 64 of the telescoping hardware 58 in the usual manner. Depending upon the amount of sliding movement that is desired to be provided between the end frame 46 and the center frame 52, telescoping hardware 58 capable of extending up to 72 inches may be provided.

It will be appreciated that the relative sliding movement between the end frames 46 and the center frame 52 translates into corresponding sliding movement between the end units 16 and 18 and the corridor sleeve unit 20. Under these circumstances, it is necessary to maintain an equidistance position among these three units and, preferably, to center the corridor sleeve unit 20 with respect to the two end units 16 and 18 under normal static conditions and dynamic conditions such as an earthquake. Accordingly, the bridge 10 further includes a centering apparatus 66 for properly centering and positioning the corridor sleeve unit 20 with respect to the two end units 16 and 18.

According to one embodiment, the centering apparatus 66 comprises two pairs of opposing tubular longitudinal shafts 68 extending perpendicularly from the center beam 54 of the center frame 52. The free ends 70 of each shaft 68 opposite the center beam 54 are received within hollow sleeves 72 connected to the end frames 46. Thus, during sliding movement between the end frames 46 and the center frame 52, by virtue of the telescoping hardware 58, the longitudinal shafts 68 of the center frame 52 will slide within the hollow sleeves 72 of the end frames 46. In this regard, the length of the hollow sleeves 72 can be dimensioned to accommodate the desired amount of relative sliding movement between the end frames 46 and the center frame 52. In addition, the free ends 70 of the longitudinal shafts 68 within the hollow sleeves 72 may be provided with an enlarged head 74 which will abut against a shoulder 76 within the hollow sleeve 72. This helps prevent the shafts 68 from separating from the hollow sleeves 72 when the extension between the end frames 46 and the center frame 52 reaches a maximum or other predetermined distance.

The centering apparatus 66 further includes a compression spring 78 around each of the longitudinal shafts 68. Each spring 78 has one end abutting against the center beam 54 of the center frame 52, and the other end abutting against a spring stop 80 located on the hollow sleeve 72 which receives the shaft 68. In the preferred embodiment, the springs 78 are metal coil compression springs having sufficient spring pressure to maintain the center frame 52 centered between the end frames 46 under both normal static conditions and dynamic conditions, such as an earthquake, when the end frames 46 might move toward or away from each other.

FIG. 12 shows the pivot apparatus 44 which pivotally connects each end unit 16 and 18 to the sub-floor 42 of the building parts 12 and 14. The sub-floor 42 may be a conventional concrete slab that forms a recess in the building floor 26 leading to the building corridor 24. The pivot apparatus 44 includes a threaded bolt 82 connected to and extending upwardly from an attachment plate 84 connected to the sub-floor 42. Also connected to the attachment plate 84 are vertical members 85, which comprise the walls of a short, right circular cylinder as cut by the plane of the section illustrated in FIG. 12. The floor 18A of the end unit 18 is joined to the threaded bolt 82 of the pivot apparatus 44 by vertical members 86, which comprise the walls of a second, short, right circular cylinder also cut by the plane of the section illustrated in FIG. 12. The upper ends of the vertical members 86 are connected to a horizontal plate 87, while the lower ends of the vertical members 86 are connected to a horizontal disc 88. The horizontal plate 87 is connected to the floor 18A of the end unit 18. The horizontal disc 88 has an aperture 90 which receives the bolt 82 and is sized so that an annular space 89 is provided between the bolt 82 and the walls of the aperture 90.

The circumferential edge 91 of the horizontal disc 88 is a convex surface radiused from the center of the horizontal disc 88 (a slice from the center of a sphere). This convex surface 91 bears against the vertical members 85 to keep each end unit 16 and 18 restrained horizontally with respect to the building parts 12 and 14, respectively, and allows the horizontal disc 88 to tilt from the horizontal position within the dimension of the annular space 89, approximately 1.5° up and down.

The upper portion of the horizontal disc 88 surrounding the aperture 90 has a convex surface that receives and is adapted to slip relative to a concave surface on a bushing 96 mounted on the bolt 82. The bushing 96 is held in place relative to the horizontal disc 88 by a washer 92 and a pair of nuts 94 which are tightened against one another. As shown in FIG. 12, the bushing 96 and the washer 92 have unthreaded apertures for receiving the bolt 82. The bolt 82 restrains uplift only. Access to the bolt 82 is provided by a removable access cover 98 in the floor 18A of the end unit 18.

The pivot apparatus 44 allows tilting action from the horizontal of the end units 16 and 18 relative to the building parts 12 and 14 to which they are respectively and movably attached. The tilting action of the pivot apparatus 44 is about the transverse axis of the seismic bridge 10. As shown in FIG. 12, and also in FIGS. 4–6, the four feet 35 which support the end units 16 and 18 are arranged along a transverse axis which is in line with the center of the pivot apparatus 44 and perpendicular with respect to the longitudinal axis of the seismic bridge 10. Since these feet 35 provide the actual vertical support for the end units 16 and 18, it is evident that no tilting action of the end units is permitted about the longitudinal axis of the bridge 10. That is, since the line of feet 35 upon which each end unit 16 and 18 is supported is perpendicular to the longitudinal axis of the seismic bridge 10, the feet act as a fulcrum to permit tilting action only about the transverse axis of the bridge.

To install the seismic bridge 10 in a building, the attachment plate 84 of the pivot apparatus 44, including the threaded bolt 82, is bolted to the sub-floor 42. Similarly, the horizontal plate 87 of the pivot apparatus 44 is bolted to the floors 16A and 18A of the end units 16 and 18. When this has been done, an assembly consisting of the two end units 16 and 18 and the corridor sleeve unit 20, together with the appropriate end frames 46 and center frame 52, are set in place so as to join the two portions of each pivot apparatus 44. That is, the horizontal disc 88 of each pivot apparatus 44 is placed over the bolt 82 so that the bolt is received within the aperture 90.

Next, the concave-faced bushing 96 and washer 92 are placed on the bolt 82, followed by the first of the two nuts 94. The first nut 94 is tightened by hand against the washer 92, since the convex surface of the horizontal disc 88 must be able to slide with respect to the concave surface of the bushing 96 to accommodate the tilting motion. With the first nut 94 in place, but only finger tight, the upper or second nut is then placed on the bolt 82 and tightened firmly against the first or lower nut.

Lateral displacement of an end unit 16 or 18, relative to the sub-floor 42, is controlled by the horizontal disc 88. The convex circumferential edge 91 of this horizontal disc 88 bears against the vertical members 85 but is free to rotate and tilt, as a sphere in a right circular cylinder of the same inside diameter. The amount of available tilt is dependent upon the size of the annular space 89. This space 89 is designed to be large enough so that the end units 16 and 18 will be permitted to tilt up or down by approximately 1.5 degrees relative to the sub-floor 42.

In view of the pivotal connection of the end units 16 and 18 to the building parts 12 and 14, and in view of the semi-cylindrical ends 36 of the end units 16 and 18 which are received within the corresponding semi-cylindrical sockets 40 of the building parts 12 and 14, the end units are allowed to rotate about a vertical axis of the pivot apparatus 44 (which essentially corresponds to the axis of the bolt 82 of the pivot apparatus 44). In addition, the end units 16 and 18 are permitted to tilt up and down from the horizontal about a horizontal transverse axis that is perpendicular to the longitudinal axis of the seismic bridge 10. This horizontal transverse axis passes through the vertical axis (bolt 82) of the pivot apparatus 44 (at the crown point of the convex surface of the horizontal disc 88), and is aligned with the feet 35. In one embodiment, the end units 16 and 18 are permitted to tilt approximately 1.5 degrees up and down about this horizontal transverse axis. In addition, relatively unrestricted rotation is provided between the end units 16 and 18 and the building parts 12 and 14.

It will be appreciated from the foregoing that the pivot apparatus 44, in combination with the corridor sleeve unit 20 that is slidably connected to the end units 16 and 18, allows the bridge 10 to accommodate a relatively wide range of relative movement between the two building parts 12 and 14 located on opposite sides of the seismic joint 11.

Figure 13A:
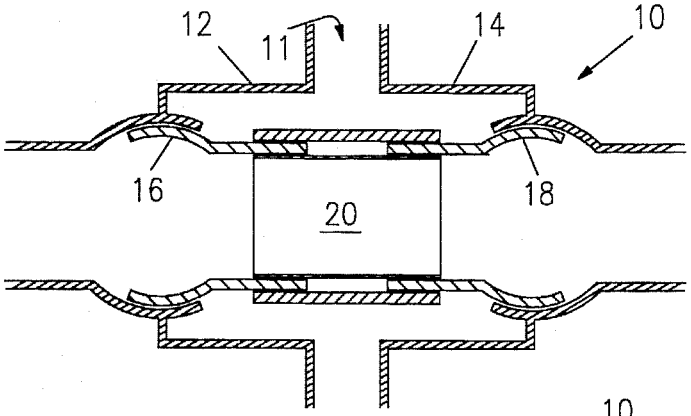
FIG. 13A is a cross-sectional plan view of the bridge, similar to FIG. 1, showing the bridge spanning a seismic joint between two building parts under neutral conditions.
Figure 13B:
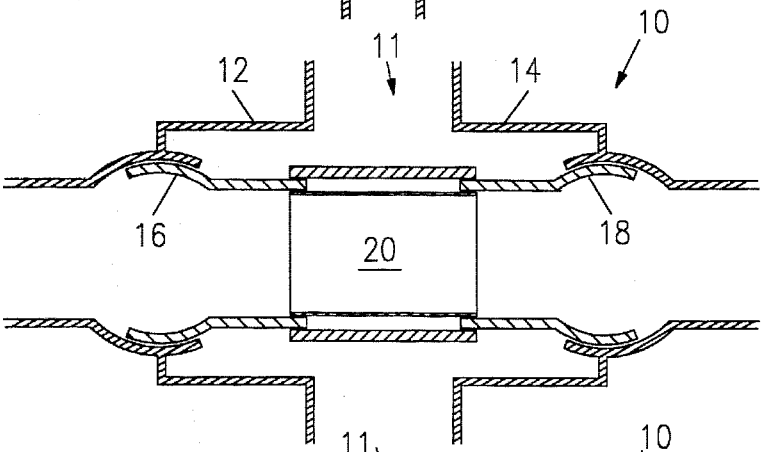
FIG. 13B is another cross-sectional plan view of the bridge, showing operation of the bridge when the building parts move away from each other, increasing the width of the seismic joint.
Figure 13C:
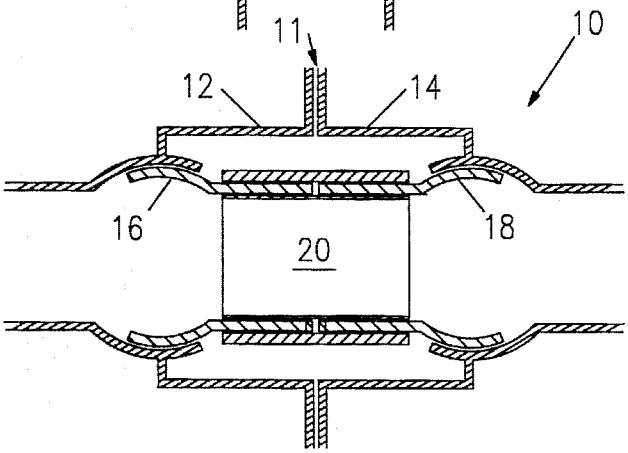
FIG. 13C is another cross-sectional plan view of the bridge, showing the operation of the bridge when the building parts move toward each other, decreasing the width of the seismic joint.
Figure 13D:
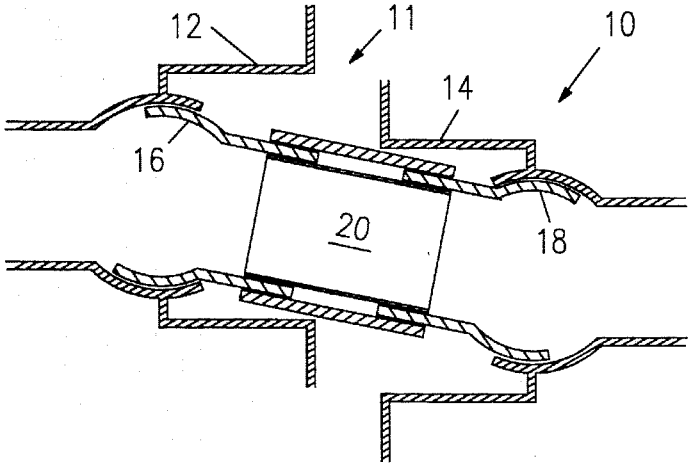
FIG. 13D is another cross-sectional plan view of the bridge, showing the operation of the bridge when the building parts move side-to-side with respect to each other.

In this regard, FIGS. 13A–13D illustrate the seismic bridge 10 in various positions depending on the relative movement between the building parts 12 and 14. In FIG. 13A, the seismic bridge 10 is shown in a position corresponding to neutral conditions spanning the seismic joint 11 between the two building parts 12 and 14. FIG. 13B shows the position of the seismic bridge 10 when the building parts 12 and 14 move away from each other to increase the width of the seismic joint 11. Movement of the two building parts 12 and 14 in this manner is accommodated by virtue of the sliding connection between the corridor sleeve unit 20 and the two end units 16 and 18. Similarly, FIG. 13C shows the position of the seismic bridge 10 when the building parts 12 and 14 move toward each other to decrease the width of the seismic joint 11. FIG. 13D shows the position of the seismic bridge 10 when the two building parts 12 and 14 move horizontally side-to-side but in opposite directions relative to each other along the seismic joint 11. In this case, the end units 16 and 18 pivot with respect to the building parts 12 and 14 to accommodate this side-to-side motion, in combination with the necessary sliding movement between the end units 16 and 18 and the corridor sleeve unit 20. Similarly, if the two building parts 12 and 14 move vertically up and down with respect to each other, the end units 16 and 18 can tilt approximately 1.5 degrees up and down from the horizontal to accommodate this motion (not shown).

It also will be appreciated that the seismic bridge 10 of the present invention can accommodate not only all of the motions described above, but it also can accommodate various combinations of these motions at the same time. All of these motions can be accommodated, without comprising the structural integrity of the bridge 10, except under extreme conditions in which the maximum range of planned motion designed into the bridge has been exceeded. In these cases, or if the building parts 12 and 14 themselves have failed, the seismic bridge 10 also will fail. However, the configuration of the bridge 10 allows it to be constructed in such a way that relatively wide ranges of movements between the two building parts 12 and 14 can be accommodated by the bridge without failure. For example, a relatively large amount of rotational movement can be provided by the end units 16 and 18 with respect to the building parts 12 and 14. In addition, the amount of relatively sliding movement between the end units 16 and 18 and the corridor sleeve unit 20 can be provided to accommodate relatively large movements of the two building parts 12 and 14 toward or away from each other. In certain designs of the seismic bridge 10, relative motions of up to eight feet have been contemplated and are believed to be made possible.

From the foregoing, it will be appreciated that the present invention provides a seismic bridge 10 for providing pedestrian access between two building parts 12 and 14 located on opposite sides of a seismic joint 11 in a seismically isolated building. In view of the sliding nature of the end units 16 and 18 and corridor sleeve unit 20 which comprise the bridge 10, together with the pivotal connection of the end units to the building parts 12 and 14, a relatively wide range of movements between the two building parts can be accommodated, without compromising the structural integrity of the bridge.

While a particular form of the invention has been illustrated and described, it will be apparent that various modifications can be made without departing from the spirit and scope of the invention. Accordingly, it is not intended that the invention be limited, except as by the appended claims.

I claim:

1. A seismic bridge for bridging and providing pedestrian access across a seismic joint between two building parts on opposite sides of the seismic joint, comprising:

(a) a first end unit having a floor with one end pivotally connected to a first building part on one side of a seismic joint, wherein the first end unit also has a free end extending away from the first building part toward the seismic joint;

(b) a second end unit having a floor with one end pivotally connected to a second building part located on the opposite side of the seismic joint from the first building part, wherein the second end unit also has a free end extending away from the second building part toward the seismic joint; and (c) a sleeve unit having a floor, with a first end of the sleeve unit being slidably connected to the free end of the first end unit, and with a second end of the sleeve unit being slidably connected to the free end of the second end unit.

2. The seismic bridge of claim 1, wherein the one end of the first end unit that is pivotally connected to the first building part has a semi-cylindrical end portion that is received for rotation within a corresponding semi-cylindrical socket of the first building part, and wherein the one end of the second end unit that is pivotally connected to the second building part has a semi-cylindrical end portion that is received for rotation within a corresponding semi-cylindrical socket of the second building part.

3. The seismic bridge of claim 2, wherein the first end unit and the second end unit are each pivotally connected to the first building part and the second building part, respectively, by a pivot apparatus having means for permitting rotational and pivoting motion of the first and second end units relative to their respective building parts.

4. The seismic bridge of claim 1, further comprising centering means for centering and properly positioning the sleeve unit with respect to the first end unit and the second end unit.

5. The seismic bridge of claim 4, wherein the centering means comprises:

(a) a first frame connected to the first end unit;

(b) a second frame connected to the second end unit;

(c) a center frame connected to the sleeve unit, wherein the center frame has a first end slidably connected to the first frame and a second end slidably connected to the second frame;

(d) a first spring biased between the first frame and the center frame; and (e) a second spring biased between the second frame and the center frame.

6. The seismic bridge of claim 5, wherein the first and second springs are each mounted on a shaft having one end fixed to the center frame and another end slidably received within a hollow sleeve connected, respectively, to each of the first frame and the second frame.

7. The seismic bridge of claim 6, wherein the first and second springs each have one end abutting against the center frame and another end abutting against a spring stop on the hollow sleeve.

8. The seismic bridge of claim 1, wherein the first and second end units each comprise a substantially horizontal floor and a substantially horizontal ceiling joined together by substantially vertical sidewalls.

9. The seismic bridge of claim 8, wherein the sleeve unit comprises a substantially horizontal floor and a substantially horizontal ceiling joined together by substantially vertical sidewalls, and wherein the sleeve unit is received within and slidably connected to each of the free ends of the first and second end units.

10. A seismic bridge for bridging and providing pedestrian access across a seismic joint between two building parts on opposite sides of the seismic joint, comprising:

(a) a first end unit having a floor with one end pivotally connected to a first building part on one side of the seismic joint, and a free end extending away from the first building part toward the seismic joint;

(b) a second end unit having a floor with one end pivotally connected to a second building part which is seismically isolated from the first building part, and a free end extending away from the second building part toward the seismic joint;

(c) a sleeve unit having a floor, with a first end of the sleeve unit being slidably connected to the free end of the first end unit, and with a second end of the sleeve unit being slidably connected to the free end of the second end unit; and (d) centering means for centering and properly positioning the sleeve unit with respect to the first end unit and the second end unit.

11. The seismic bridge of claim 10, wherein the first end unit and the second end unit are each pivotally connected to the first building part and the second building part, respectively, by a pivot apparatus that permits the first and second end units to rotate about a vertical axis and to tilt from the horizontal.

12. The seismic bridge of claim 11, wherein the one end of the first end unit that is pivotally connected to the first building part has a semi-cylindrical end portion that is received with a corresponding semi-cylindrical socket of the first building part, and wherein the one end of the second end unit that is pivotally connected to the second building part has a semi-cylindrical end portion that is received within a corresponding semi-cylindrical socket of the second building part.

13. The seismic bridge of claim 11, wherein the centering means comprises:

(a) a first frame connected to the first end unit;

(b) a second frame connected to the second end unit;

(c) a center frame connected to the sleeve unit, wherein the center frame has a first end slidably connected to the first frame and a second end slidably connected to the second frame;

(d) a pair of first springs biased between the first frame and the center frame; and (e) a pair of second springs biased between the second frame and the center frame.

14. The seismic bridge of claim 13, wherein each spring in the pair of first and second springs is mounted on a shaft having one end fixed to the center frame and another end slidably received within a hollow sleeve connected, respectively, to one of the first frame and the second frame.

15. The seismic bridge of claim 14, wherein the first and second end units each comprise a substantially horizontal floor and a substantially horizontal ceiling joined together by substantially vertical sidewalls.

16. The seismic bridge of claim 15, wherein the sleeve unit comprises a substantially horizontal floor and a substantially horizontal ceiling joined together by substantially vertical sidewalls, and wherein the sleeve unit is received within and slidably connected to each of the free ends of the first and second end units.

17. A combination, comprising:

(a) a first building part having a path to provide pedestrian travel;

(b) a second building part that is seismically isolated from the first building part, wherein the second building also has a path to provide pedestrian travel; and (c) a seismic bridge for bridging and providing pedestrian access across a seismic joint separating the paths of the first and second building parts, comprising:

a first end unit having a floor with one end pivotally connected to the path of the first building part, and a free end extending away from the first building part toward the seismic joint, a second end unit having a floor with one end pivotally connected to the path of the second building part, and a free end extending away from the second building part toward the seismic joint, and a sleeve unit having a floor, with a first end of the sleeve unit being slidably connected to the free end of the first end unit, and with a second end of the sleeve unit being slidably connected to the free end of the second end unit.

18. The combination of claim 17, wherein the seismic bridge includes a centering apparatus for centering and properly positioning the sleeve unit with respect to both the first end unit and the second end unit, wherein the centering apparatus comprises:

(a) a first frame connected to the underside of the first end unit;

(b) a second frame connected to the underside of the second end unit;

(c) a center frame connected to the underside of the sleeve unit, wherein the center frame has a first end slidably connected to the first frame and a second end slidably connected to the second frame;

(d) a pair of first springs biased between the first frame and the center frame;

(e) a pair of second springs biased between the second frame and the center frame;

(f) a pair of first shafts, each shaft having one end fixed to the center frame and another end slidably received within a hollow sleeve connected to the first frame, wherein each spring in the pair of first springs is mounted on one of said shafts; and (g) a pair of second shafts, each shaft having one end fixed to the center frame and another end slidably received within a hollow sleeve connected to the second frame, wherein each spring in the pair of second springs is mounted on one of said shafts.

19. The combination of claim 18, wherein the one end of the first end unit that is pivotally connected to the first building part has a semi-cylindrical end portion that is received within a corresponding semi-cylindrical socket of the first building part, and wherein the one end of the second end unit that is pivotally connected to the second building part has a semi-cylindrical end portion that is received within a corresponding semi-cylindrical socket of the second building part.

20. The combination of claim 19, wherein the first end unit and the second end unit are each pivotally connected to the first building part and the second building part, respectively, by a pivot apparatus that permits the first and second end units to rotate about a vertical axis and to tilt from the horizontal.

21. A pedestrian bridge for bridging and providing pedestrian travel across a seismic joint between two seismically isolated building parts on opposite sides of the seismic joint, comprising:

(a) a first end unit having a floor with one end pivotally connected to a first building part on one side of the seismic joint, wherein the first end unit also has a free end extending away from the first building part toward the seismic joint;

(b) a second end unit having a floor with one end pivotally connected to a second building part located on the opposite side of the seismic joint from the first building part, wherein the second end unit also has a free end extending away from the second building part toward the seismic joint; and (c) a sleeve unit having a floor, with a first end of the sleeve unit being slidably connected to the free end of the first end unit, and with a second end of the sleeve unit being slidably connected to the free end of the second end unit, wherein the floors of the first end unit, the second end unit, and the sleeve unit cooperate to permit pedestrian travel across the seismic joint.

* * * * *